United States Patent [19]

Norbeck

[11] 4,114,500

[45] Sep. 19, 1978

[54] PAD FOR WOODWIND MUSICAL INSTRUMENT

[75] Inventor: Edwin Norbeck, Iowa City, Iowa

[73] Assignee: The University of Iowa Research Foundation, Iowa City, Iowa

[21] Appl. No.: 688,503

[22] Filed: May 20, 1976

[51] Int. Cl.[2] ..... G10D 9/04

[52] U.S. Cl. ..... 84/385 P

[58] Field of Search ..... 84/385 P, 60–64

[56] References Cited

U.S. PATENT DOCUMENTS

| | | | |
|---|---|---|---|
| 2,759,386 | 8/1956 | Pascucci | 84/385 P X |
| 2,957,381 | 10/1960 | Hillyard | 84/385 P |
| 3,958,484 | 5/1976 | Nelson et al. | 84/385 P X |

FOREIGN PATENT DOCUMENTS

| | | | |
|---|---|---|---|
| 919,173 | 2/1947 | France | 84/385 P |
| 1,937,806 | 2/1971 | Fed. Rep. of Germany | 84/385 P |
| 716,943 | 2/1942 | Fed. Rep. of Germany | 84/385 P |

OTHER PUBLICATIONS

"Material News from Dow Corning", May–Jun. 1974.

*Primary Examiner*—Lawrence R. Franklin
*Attorney, Agent, or Firm*—Beveridge, DeGrandi, Kline & Lunsford

[57] ABSTRACT

A pad for closing the tone hole of a woodwind instrument is formed of a disc of silicone rubber having a compression set at room temperature after 22 hours no greater than about 5%.

The edge surfaces of the disc are tapered, and a backing disc of sheet material is provided to facilitate installation of the elastomer disc in many instruments.

6 Claims, 2 Drawing Figures

FIG. 1
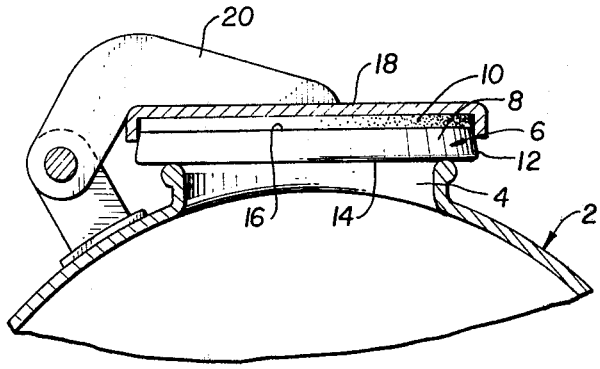
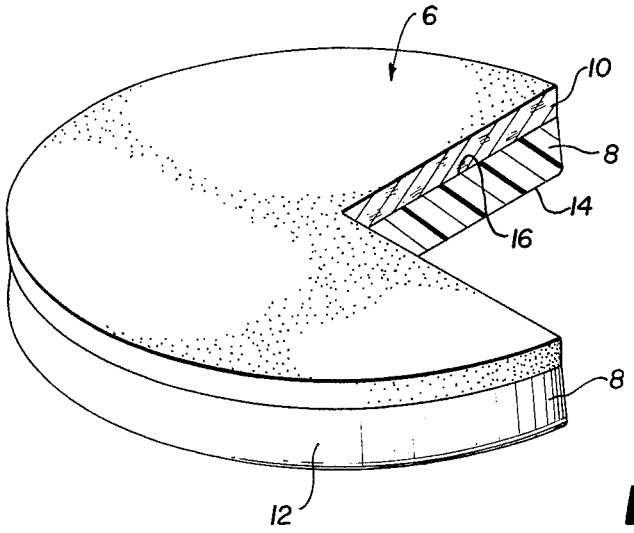
FIG. 2

PAD FOR WOODWIND MUSICAL INSTRUMENT

BACKGROUND OF THE INVENTION

This invention relates to pads which close the tone holes of woodwind musical instruments including but not limited to flutes, saxophones, bassoons, oboes, piccolos and clarinets.

The predominant pad now used is a bladder pad formed of a bottom disc of cardboard and an upper disc of felt. A covering of one to three layers of a thin membranous material called the "bladder skin" covers the felt disc, is wrapped around the edges of both discs and is bonded to the cardboard disc. Another common pad is the leather pad which is similar to the bladder pad but in lieu of a "bladder skin" has an enveloping layer of thin, soft leather. The bladder pads and leather pads perform well but are readily damaged by water, oil, insects and metal polishing compounds.

Sheet cork is also used for pads, particularly in oboes and piccolos. These have the advantage of producing crisp transitions between notes, but have the disadvantage of producing a conspicuous click when the pad is closed against the tone hole. These pads are more durable than bladder pads or leather pads, but their installation is more difficult.

There have been many proposals for various types of elastomer pads formed from natural or synthetic organic resins such as natural rubber or polyvinyl chloride. These pads have not been widely accepted. Some elastomer pads become sticky due to their compounding with excessive amounts of plasticisers. Some elastomer pads discolor, age, undergo a change in texture or compress excessively to give the performer a spongy feel. Others have a corrosive effect on metallic instruments.

The present invention provides an elastomer pad which avoids the disadvantages described above, and provides for long life, a good "feel" to the musician, substantially noiseless operation and an aversion to sticking to the tone hole. This is achieved by the selection of an elastomer, preferably of a silicone rubber, having a compression set which is no greater than about 5% after being compressed to 75% of its original thickness at room temperature for 22 hours and then released for one-half hour.

Preferably, the woodwind pad of the invention includes such an elastomer disc and a backing disc, the edges of the elastomer disc being tapered outwardly in the direction of the tone hole to minimize the surface area facing the pad cup and to maximize the surface facing the tone hole. Also, it is preferred that the elastomer disc have a durometer of about 20–60 on the Shore A scale.

For a more complete understanding of the invention, a preferred embodiment is shown in the accompanying drawings and described in the following description.

BRIEF DESCRIPTION OF THE DRAWINGS

FIG. 1 is a sectional view through a musical instrument, showing the elastomer pad installed in a pad cup and held in sealing relationship with a tone hole.

FIG. 2 is a perspective view of an elastomer pad of the invention, cut away to show its cross sectional construction.

BRIEF DESCRIPTION OF A PREFERRED EMBODIMENT

FIG. 1 shows a typical saxophone construction wherein the body 2 of the instrument has a tone hole 4 which is opened and closed to change the note produced by the instrument. Opening and closing of the tone hole 4 is done by the movable pad 6 which is the subject of this invention. The pad 6 is formed of an elastomer disc 8 and a backing disc 10, the elastomer disc having a tapered edge 12 between its larger front face 14 and its smaller rear face 16. The pad 6 is supported in a cup 18 on arm 20 which is operated by a lever or by finger contact.

The backing disc 10 adds a slight degree of stiffness to the pad and facilitates its installation under certain circumstances. This disc 10 is thinner than the elastomer and may be made of any one of many materials such as cork, high quality cardboard or a material known as "composition cork" formed of small particles of cork in a nitrile rubber matrix. The front and rear faces of the backing disc are geometrically congruent, its front face being bonded to the elastomer disc, and its rear face being attached to the pad cup 18 to serve as the rear face of the pad. In certain instruments where the pad must be contoured into a convex configuration, the backing may be made of thin paper; and, in instruments which have mechanical pad-holding means, the backing may be entirely eliminated.

According to this invention, the elastomer disc 8 of pad 6 is formed of an elastomer which has a low compression set being no greater than about 5% and preferably less than 1% after being compressed to 75% of its original thickness at room temperature (about 23° C.) for 22 hours and then released for one-half hour. Compression set is calculated by the following formula:

$$(t_o-t_i)/(t_o-t_s) \times 100$$

where $t_o$ is the original thickness of the specimen, $t_i$ is the final thickness of the specimen and $t_s$ is the thickness of the specimen when compressed.

The standards for measurement and calculation of compression set as used herein are described as Method B in ASTM standard D-395-69 which is incorporated herein by reference.

Materials having the desired compression set capabilities are certain commercially available silicone rubbers which contain silicon, oxygen and one or more organic groups. General purpose silicone rubber is polydimethylsiloxane made up of alternating silicon and oxygen molecules with two methyl groups attached to each silicon. Unsaturated groups such as vinyl groups or phenyl groups may be substituted for a small part of the methyl groups. Another type of silicone rubber is fluorosilicone, polytrifluoropropylmethyl siloxane.

A suitable silicone rubber is processed and sold in sheet form under the trademark CORHLASTIC by Connecticut Hard Rubber Company, 407 East Street, New Haven, Conn. This material is said to be odorless, tasteless and nontoxic; and, it is not deteriorated by sunlight, moisture, radiation and oxidation. It has a useful temperature range from −100° F. to +500° F. The material is available in 1/16 inch thickness which is suitable for most woodwind instrument pads.

The preferred materials are CORHLASTIC 300, CORHLASTIC 400 and CORHLASTIC 9235, the properties of which are described in circular SR-1W-

1/74 of Connecticut Hard Rubber Company, this circular being incorporated herein by reference. These materials have a Shore A Durometer of about 30–40, a tensile strength of about 850–1150 psi, an elongation of about 400–700 percent and a tear strength of about 40 to 140 pounds per inch.

The pads of this invention may be made by conventional manufacturing processes. A punch-and-die couple is used to cut the elastomer discs 8 from a sheet of the appropriate material. The diameter of the punch is selected according to the desired diameter of the elastomer disc 8 of the pad. The punch has a slightly conical end which first contacts the sheet of elastomer, the included angle of the cone being about 170°. An upper guide plate directs the cone against the selected area of the sheet of elastomer, and a lower die plate receives the punch to shear the elastomer. Prior to the shearing action, the elastomer is deformed by compression into the die, thereby producing the tapered edge on the elastomer disc used in the pad.

The backing pieces 10 may be die cut according to conventional processes for cutting sheet materials such as cork or cardboard. These backing pieces are adhered to the elastomer pieces by an appropriate adhesive, the most suitable of which is liquid RTV (room temperature vulcanizing) rubber. Such adhesives are available in hardware stores. Preferably, the backing disc and elastomer disc are pressed together overnight while the adhesive cures. It is also suitable to use cyanoacrylate adhesive or elastomers precoated with a pressure sensitive silicone polymer adhesive, the latter being available from the Connecticut Hard Rubber Company.

It is desirable to bond a sheet of the backing material to the elastomer sheet before performing the punching operation. This guarantees that the backing is properly aligned with the front of the pad. In order to make the backing lie in the right direction, that is, so the front face of the pad is larger than the backing, the punch must first contact the backing side. If the backing is not stiff enough to allow the punching process to produce the correct taper, one or more pieces of cardboard may be laid against the backing to provide additional stiffness during punching.

The pads are installed in the conventional pad cup using conventional techniques appropriate to the particular musical instrument. For most woodwind instruments, this involves a shellac-type cement which is heated in the course of pad installation. When the cement cools, the pad is firmly held in the cup. Since the shellac cement will adhere to the backing disc but will not adhere to the elastomer disc 8, any cement inadvertently deposited on the elastomer disc may be easily removed without harming the pad. If the shellac-heating flame accidentally strikes the elastomer pad, no harm will be done since the elastomer is not affected by heat of this intensity and duration. This provides an advantage over many prior pads which are destroyed when contacted by a flame.

Certain advantages are realized by having the front face 14 of the pad slightly larger than its rear face. This permits the front face 14 of the pad to be larger than the pad cup and the rear face of the pad to be smaller than the pad cup. During pad installation, the smaller rear face tends to avoid the entrapment of air bubbles under the pad and permits shifting of the pad laterally or to a different angle in the cup. The enlarged front face 14 of the elastomer disc ensures contact between the pad and the tone hole in those instruments in which a pad cup is made too small relative to its corresponding tone hole.

Those skilled in the art will appreciate that the invention may be practiced by means other than the specific embodiments described hereinabove. Accordingly, it is emphasized that the invention is not limited to these embodiments but encompasses other subject matter within the scope and spirit of the claims which follow.

I claim:

1. A valve pad for a musical instrument, said pad comprising an elastomer disc formed of silicone rubber which has a Shore A durometer of about 20 to 60 and a compression set no greater than about 5%, said compression set being determined after applying for 22 hours at about 23° C. a force which compresses the composition about 25% and measuring the thickness 30 minutes after said force is released, said compression set being equal to $$(t_o - t_i)/(t_o - t_s) \times 100$$

where $t_o$ is the original thickness of the specimen, $t_i$ is the final thickness of the specimen and $t_s$ is the thickness of the specimen when compressed by said force.

2. The pad of claim 1 wherein the compression set is no greater than about 1%.

3. The pad of claim 1 having a flat front face and a rear face which is smaller than the front face, said pad having an edge which is tapered.

4. The pad of claim 3 in combination with a woodwind instrument having a pad cup with a pad-receiving recess facing a tone hole, said pad having a rear face attached to said pad cup, said rear face being smaller than the recess of said pad cup to enable movement of the pad in the pad cup during installation of the pad, and means for connecting said rear face to the pad cup.

5. The pad of claim 4 wherein the front face of said pad is larger than the recess of the pad cup to maximize the area of said pad confronting said tone hole and to ensure contact between said front face and the tone hole.

6. The pad of claim 1 in combination with a woodwind instrument having a pad cup with a pad-receiving recess facing a tone hole, said pad having a rear face attached to said pad cup, said pad also having a flat front face which is larger than the recess and larger than said rear face.

* * * * *